US008342673B2

(12) United States Patent
Yoda

(10) Patent No.: US 8,342,673 B2
(45) Date of Patent: Jan. 1, 2013

(54) PRINTING APPARATUS

(75) Inventor: Kaneo Yoda, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 398 days.

(21) Appl. No.: 12/543,658

(22) Filed: Aug. 19, 2009

(65) Prior Publication Data

US 2010/0053291 A1 Mar. 4, 2010

(30) Foreign Application Priority Data

Aug. 28, 2008 (JP) ..... 2008-219274
May 18, 2009 (JP) ..... 2009-119546

(51) Int. Cl.
*B41J 2/01* (2006.01)

(52) U.S. Cl. ..... 347/102; 347/104

(58) Field of Classification Search ..... None
See application file for complete search history.

(56) References Cited

U.S. PATENT DOCUMENTS 5,631,685 A * 5/1997 Gooray et al. ..... 347/102
5,764,263 A * 6/1998 Lin ..... 347/101
6,004,052 A * 12/1999 Muranaka ..... 400/636
6,092,891 A * 7/2000 Okubo et al. ..... 347/104
6,536,894 B1 * 3/2003 Rasmussen et al. ..... 347/104
2005/0151815 A1 * 7/2005 Kanai et al. ..... 347/102
2008/0158325 A1 * 7/2008 Koike ..... 347/102
2008/0180507 A1 * 7/2008 Furukawa ..... 347/104

FOREIGN PATENT DOCUMENTS

JP 03-251474 11/1991

* cited by examiner

*Primary Examiner* — Stephen Meier
*Assistant Examiner* — Leonard S Liang
(74) *Attorney, Agent, or Firm* — Workman Nydegger

(57) ABSTRACT

Provided is a printing apparatus including: a head unit that ejects liquid on a printing medium that is transported in a printing medium transport direction; a transporting roller unit that is disposed at a printing medium transport direction upstream side of the head unit; a transporting belt unit that is disposed at a printing medium transport direction downstream side of the head unit; an intermediate supporting unit that is disposed at a side facing the head unit; and a heating unit that is disposed to at least one of the transporting roller unit, the transporting belt unit and the intermediate supporting unit to heat the printing medium, wherein the heating unit heats the printing medium so that a temperature T1 of the transporting roller unit, a temperature T2 of the intermediate supporting unit, and a temperature T3 of the transporting belt unit satisfy a relationship of T1<T2<T3.

8 Claims, 4 Drawing Sheets

PRINTING APPARATUS

BACKGROUND

1. Technical Field

The present invention relates to a printing apparatus that prints an image or the like by ejecting liquid on a printing medium.

2. Related Art

An ink jet printer having one printing apparatus forms micro ink dots on a printing medium by ejecting (spraying) liquid ink droplets from nozzles of a liquid ejecting head (sometimes, referred to as an "ink jet head") so that an image or the like is printed. As an example of the ink jet printer, there is a multi-pass type ink jet printer where the ink jet head is mounted on a moving body referred to as a carriage to be moved in a direction intersecting a transport direction of the printing medium. In addition, in another example of the ink jet printer, there is a line head type ink jet printer where printing is performed by an ink jet head that is elongated (not necessarily integrally provided) in the direction intersecting the transport direction of the printing medium (that is, so-called one-pass printing can be performed).

In such an ink jet printer, a process of heating the printing medium is performed so as to dry and fix the printed ink on the printing medium. Various types of printing medium heating units for the printing apparatuses have been proposed. For example, in a printing apparatus disclosed in JP-A-3-251474, a heating plate unit for heating the printing medium along the transport path of the printing medium is provided. In addition, in the printing apparatus, the printing medium is heated to have a preliminary heat before the printing, the printing medium is heated at a temperature lower than the preliminarily heating temperature during the printing, and the printing medium is heated at a high temperature to rapidly dry the ink after the printing.

However, like the printing apparatus disclosed in the JP-A-3-251474, in a case where the heating temperature during the printing on the printing medium is designed to be lower than the heating temperatures before and after the printing, the temperature of the printing medium at the time of the preliminary heating is designed to be high in order to dry the ink. In addition, when the printing medium in the preliminarily heated state is contacted and transported by a PF (paper feed) roller having no heater, the temperature of the printing medium is decreased. After that, every time when the printing on the printing medium is continuously repeated, the temperature of the PF roller is increased, so that the temperature of the printing medium is also increased. Therefore, the temperature of the printing medium during the printing cannot be maintained at a constant level. As a result, the ink absorption capability of the printing medium is varied with the printing, so that concentration non-uniformity, color non-uniformity, or the like may occur. Therefore, uniformity of image quality may not be secured.

SUMMARY

An advantage of some aspects of the invention is to solve at least a portion of the aforementioned problems. The invention can be implemented by using the following aspect or application examples.

Application Example 1

An advantage of some aspects of the invention is to provide a printing apparatus including: a head unit that ejects liquid on a printing medium that is transported in a printing medium transport direction; a transporting roller unit that is disposed at a printing medium transport direction upstream side of the head unit; a transporting belt unit that is disposed at a printing medium transport direction downstream side of the head unit; an intermediate supporting unit that is disposed at a side facing the head unit; and a heating unit that is disposed to at least one of the transporting roller unit, the transporting belt unit and the intermediate supporting unit to heat the printing medium, wherein the heating unit heats the printing medium so that a temperature T1 of the transporting roller unit, a temperature T2 of the intermediate supporting unit, and a temperature T3 of the transporting belt unit satisfy a relationship of T1<T2<T3.

According to the printing apparatus, the printing medium can be heated and dried by a heating unit that is disposed to at least one of the transporting roller unit at the upstream side of the head unit, the intermediate supporting unit at the side facing the head unit, and the transporting belt unit at the downstream side of the head unit in the printing medium transport direction. In addition, the temperature T2 of the intermediate supporting unit at the time of printing is designed to be higher than the temperature T1 of the transporting roller unit before the printing, and the temperature T3 of the transporting belt unit after the printing is designed to be higher than the temperature T2. In other words, the printing medium is sequentially heated along the transport path from a low temperature to a high temperature. Accordingly, the temperature of the printing medium before the printing can be suppressed to be low, and the temperature of the printing medium at the time of the printing can be equal to or less than the temperature T2. As a result, nozzle clogging of the head unit caused by an increase in ink viscosity can be prevented, so that highly reliable printing without a defective image can be performed.

Application Example 2

In the printing apparatus according to the above application example, the transporting roller unit may be constructed with a pair of upper and lower rollers, and the heating unit may be disposed to at least one of the pair of upper and lower rollers.

Application Example 3

In the printing apparatus according to the above application example, the intermediate supporting unit may be a platen that supports the printing medium, and the heating unit may be disposed to the platen.

Application Example 4

In the printing apparatus according to the above application example, the transporting belt unit may include a transporting belt, and the heating unit may be disposed to a roller that abuts on the transporting belt.

Application Example 5

In the printing apparatus according to the above application example, the head units may be disposed to be divided into the head units at the printing medium transport direction upstream side and the head units at the printing medium transport direction downstream side, and the printing apparatus may further include an intermediate transporting unit that is constructed with a pair of upper and lower rollers that are disposed between the head unit disposed at the printing medium transport direction upstream side and the head units disposed at the printing medium transport direction downstream side.

Application Example 6

In the printing apparatus according to the above application example, the heating unit may be disposed to at least one of the pair of upper and lower rollers in the intermediate transporting unit.

Application Example 7

In the printing apparatus according to the above application example, the one of the pair of upper and lower rollers in the intermediate transporting unit may be an intermediate pressing roller, and the intermediate pressing roller may abut on a portion other than an area of the printing medium on which the liquid is ejected from the head unit disposed at the printing medium transport direction upstream side.

Application Example 8

In the printing apparatus according to the above application example, the head units at the printing medium transport direction upstream side and the head units at the printing medium transport direction downstream side may be disposed so that the position thereof is shifted in an alternate manner in a direction intersecting the printing medium transport direction as viewed in plane, and the intermediate pressing roller may be disposed between the adjacent head units disposed at the printing medium transport direction upstream sides in the direction intersecting the printing medium transport direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, as an example of a printing apparatus, an ink jet printer that prints an image or the like on a printing medium such as a printing sheet by ejecting ink will be described. The later-described ink jet printer includes a plurality of ink jet heads (head units) that are aligned in a direction intersecting a printing medium transport direction. The ink jet printer is a line head type ink jet printer where so-called one-pass printing can be performed by using such ink jet heads.

First Embodiment

Figure 1:
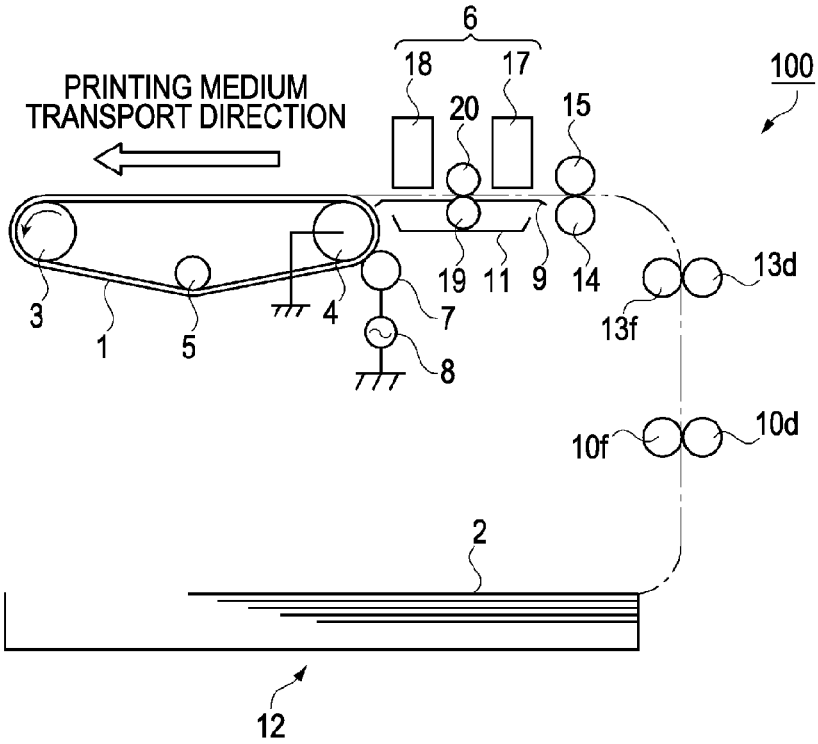
FIG. 1 is a schematic cross-sectional side view showing a configuration of an ink jet printer according to a first embodiment.

FIG. 1 is a schematic cross-sectional side view showing a configuration of an ink jet printer 100 according to a first embodiment. As shown in the figure, before being fed, printing medium 2 are stored in a feed unit 12. The printing medium 2 is fed toward a later-described head unit group 6 by a pair of auxiliary rollers 10*d* and 10*f* and a pair of feed rollers 13*d* and 13*f*.

At the front side of the head unit group 6, that is, at the printing medium transport direction upstream side of the head unit group 6, a pair of upper and lower rollers (a lower transfer roller 14 and an upper pressing roller 15) are disposed as a transporting roller unit. The transfer roller 14 and the pressing roller 15 correct a posture of the printing medium 2 fed from the feed rollers 13*d* and 13*f* and adjust a transport timing of the printing medium 2 to transport the printing medium 2 at the adjusted transport timing to an area just below the head unit group 6 (hereinafter, referred to as a "printing area"). In addition, in order to increase a printing medium transporting force by increasing a frictional coefficient of the transfer roller 14, surface coating with, for example, urethane or ceramic particles may be performed on a surface of the transfer roller 14.

The head unit group 6 is a liquid ejecting head that ejects (sprays) liquid such as ink in a shape of droplets. As an intermediate supporting unit, a platen 9 is disposed at a position facing the head unit group 6. An upper surface of the platen 9 is formed to be substantially horizontal, and the printing medium 2 is guided in a substantially horizontal posture between the head unit group 6 and the platen 9. Therefore, while the printing medium 2 is transported in the printing medium transport direction, the required printing is performed thereon by the head unit group 6. After that, the printing medium 2 is transported (discharged) in the same direction (printing medium transport direction). In addition, hereinafter, a direction that is parallel to the upper surface of the platen 9 and that intersects the printing medium transport direction, that is, a leftward/rightward direction with respect to the printing medium transport direction is referred to as an "intersect direction".

Figure 2:
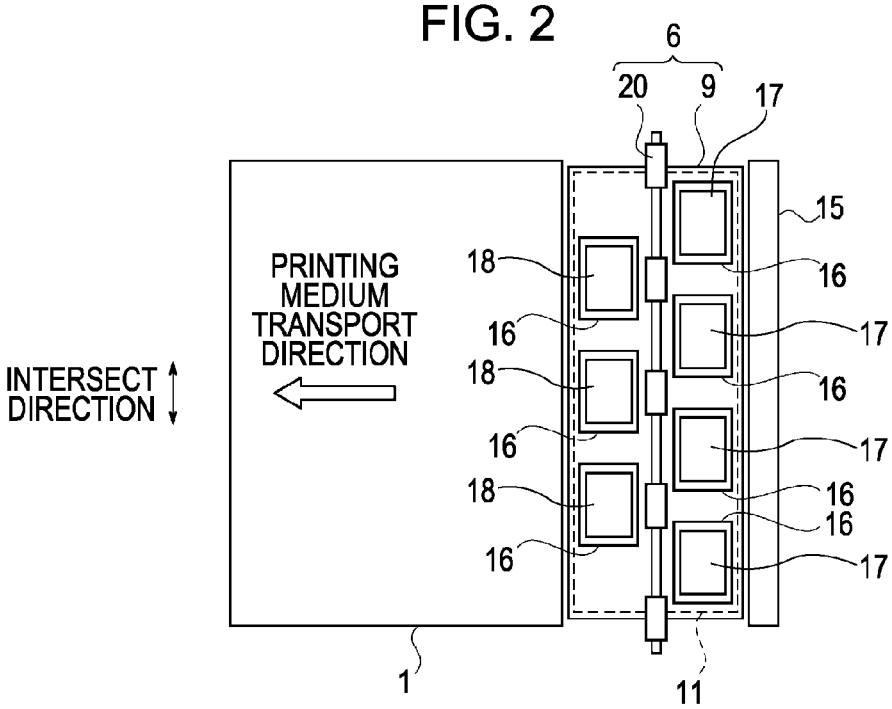
FIG. 2 is a plan view showing an ink jet printer as viewed from an upper side.

FIG. 2 is a plan view showing the ink jet printer 100 as viewed from an upper side. As shown in the figure, the head unit group 6 includes a plurality of relatively small head units 17 and 18, for each of which the intersect direction length is in a range of about 30 mm to about 40 mm. The head units 17 and 18 are divided (separated) in the printing medium transport direction so that the two columns thereof are aligned at the printing medium transport direction upstream and downstream sides. The head units 17 and 18 of the columns are also divided (separated) in the intersect direction so as to be aligned in a zigzag shape as viewed in plane, that is, so as to be alternately aligned along the intersect direction at the printing medium transport direction upstream and downstream sides. In addition, hereinafter, among the head units 17 and 18 included in the head unit group 6, the head unit 17 that is disposed at the printing medium transport direction upstream side is referred to as a "upstream side head unit 17", and the head unit 18 that is disposed at the printing medium transport direction downstream side is referred to as a "downstream side head unit 18".

Figure 3:
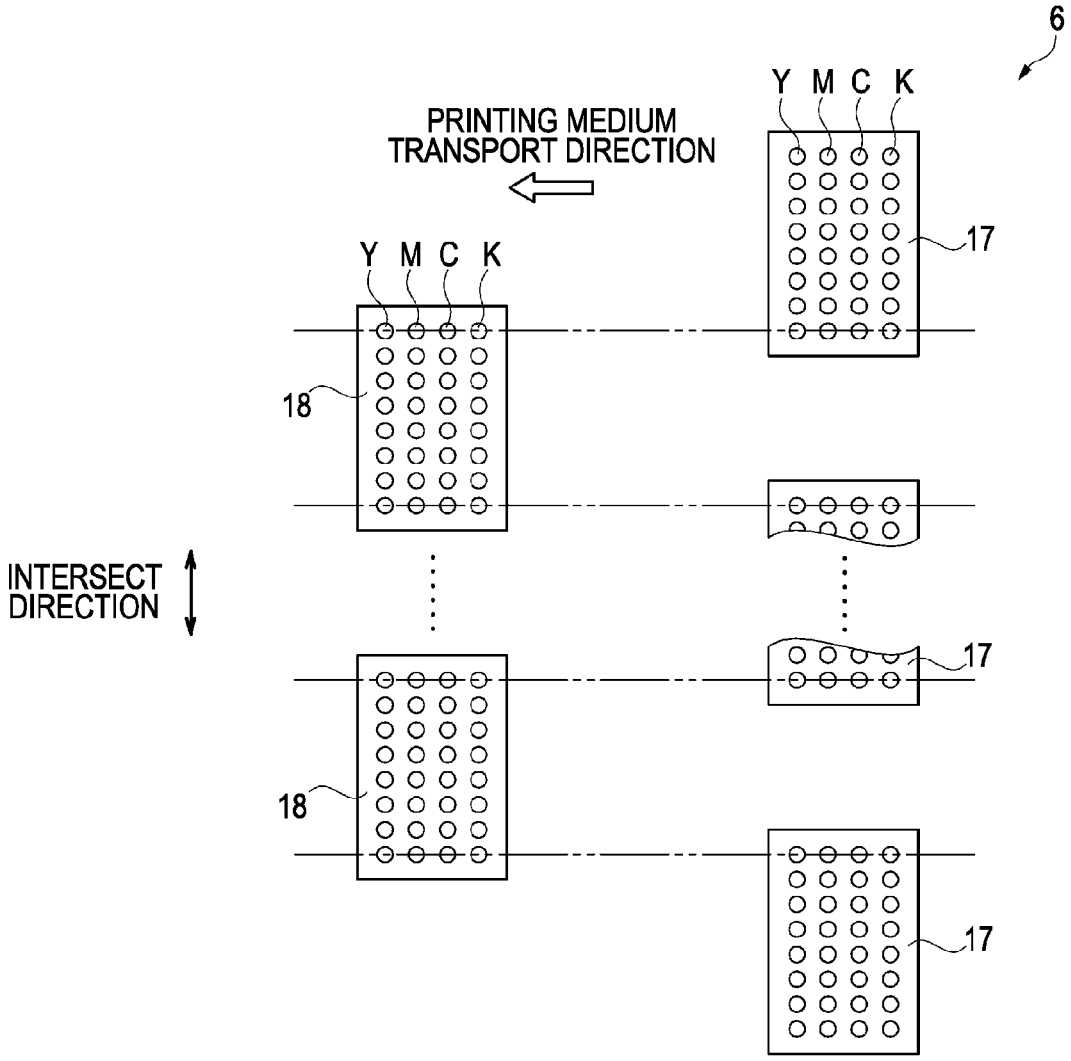
FIG. 3 is a view for explaining an array of a head unit group.

FIG. 3 is a view for explaining an array of the head unit group 6. In the figure, the head unit group 6 is viewed from the lower side. As shown in the figure, a plurality of nozzles that eject ink droplets is formed on a surface (nozzle surface) of each of the head units 17 and 18 facing the platen 9. More specifically, four nozzle columns each of which is constructed with a plurality of nozzles that are aligned in the intersect direction are formed on the nozzle plane to be separated from each other in the printing medium transport direction. The four nozzle columns are designed to eject different color inks. In the embodiment, the four nozzle columns eject black (K), cyan (C), magenta (M), and yellow (Y) inks in this order from the printing medium transport direction upstream side. In addition, micro ink dots are formed on the printing medium 2 by simultaneously ejecting the required amounts of ink droplets from the nozzles at the required positions for each color, that is, for each nozzle column. The ink jet printer 100 repeats the operation while transporting the printing medium 2 in the printing medium transport direction. In addition, in the state that the position of the head unit group 6 is fixed, an image having a width corresponding to a distance between both end nozzles of the head unit group 6 in the intersect direction may be printed in one pass, that is, in transportation of the printing medium 2 in the printing medium transport direction.

In addition, the type of ejection of the ink from the nozzles is not limited to a specific type, but various types such as an electrostatic type, a piezo type, and a film boiling ink jet type may be employed. In the electrostatic type, a driving pulse is applied to an electrostatic gap, so that a vibrating plate in a cavity has a displacement. Due to a change in the pressure of the cavity caused by the displacement, ink droplets are ejected. In the piezo type, a driving pulse is applied to a piezo device, so that a vibrating plate in a cavity has a displacement. Due to a change in pressure of the cavity caused by the displacement, ink droplets are ejected. In the film boiling ink jet type, ink is heated by a micro heater provided inside a cavity, so that bubbles are generated. Due to a change in pressure resulting from the generation of the bubbles, ink droplets are ejected.

Returning to FIG. 1, the platen 9 is disposed at the downstream side of the transfer roller 14 and the pressing roller 15 so as to face the nozzle plane of the head unit group 6 (head units 17 and 18). The platen 9 is a plane regulating member that has a planar shape to regulate the flatness of the printing medium 2 transported to a printing area. In the line head type head unit group 6 like the embodiment, the platen 9 is an important member in terms of ejecting the ink droplets at a predetermined position and sustaining the gap between the head unit group 6 and the printing medium 2. In addition, a series of ink reception members 11 that cover at least a range of ejecting ink droplets from the head unit group 6 are disposed under the platen 9. As shown in FIG. 2, through-holes 16 for allowing the ink droplets ejected from the head units 17 and 18 to penetrate are formed on the platen 9. In a case where the ink droplets are ejected from the head unit group 6 in a state where the printing medium 2 does not exist above the platen 9, the ink droplets penetrate through the through-holes 16 of the platen 9 and are received by the ink reception members 11.

In the ink jet printer 100, the so-called edgeless printing where the printing is performed as far as the circumferential portions of the printing medium 2 is performed by ejecting the ink droplets as far as the portions slightly outside the outer appearance of the printing medium 2. Even in this case, the ink droplets ejected to the portions outside the outer appearance of the printing medium 2 penetrate through the through-holes 16 of the platen 9 and are received by the ink reception member 11, so that no ink is attached on the upper surface of the platen 9. Therefore, the rear surface (a surface opposite to the printing surface) of the following printing medium 2 cannot be contaminated by the ink that protrudes from the printing medium 2. In addition, since the through-holes 16 are formed, flushing, that is, an empty stroke operation for restoring the nozzles of the head unit group 6 is also available.

In addition, a cleaning unit (not shown) may be provided under the platen 9. The cleaning unit is constructed with, for example, caps, suction devices, or the like that are disposed to face the head units 17 and 18. Herein, the cap is a box body of which the upper side is opened. The cap receives the ink that penetrates through the through-hole 16. In addition, the cap may be lifted through the through-hole 16 to abut the head unit 17 or 18 so that the nozzle plane can be sealed. In addition, the suction device sucks up the ink collected in the bottom portion of the cap and performs the nozzle cleaning by performing suction in the state where the nozzle plane is sealed by the cap.

In addition, in the embodiment, as shown in FIG. 1, a pair of upper and lower rollers (lower intermediate roller 19 and upper intermediate pressing roller 20) are disposed as an intermediate transporting unit between the upstream side head unit 17 and the downstream side head unit 18. The intermediate roller 19 and the intermediate pressing roller 20 have a function of transporting the printing medium 2 in the printing medium transport direction and a function of sustaining the gap between the head units 17 and 18 and the printing medium 2 by regulating the flatness of the printing medium 2 under the head units 17 and 18 (particularly, the downstream side head unit 18).

Figure 4A:
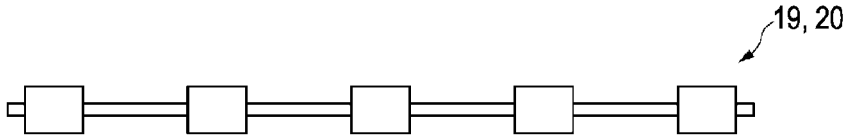
FIGS. 4A to 4C are views showing an intermediate roller and an intermediate pressing roller.
Figure 4B:
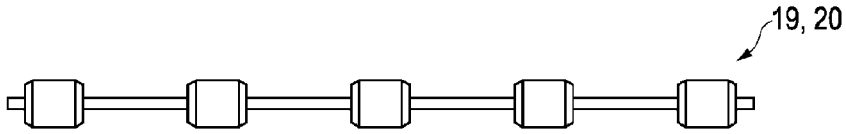
Figure 4C:
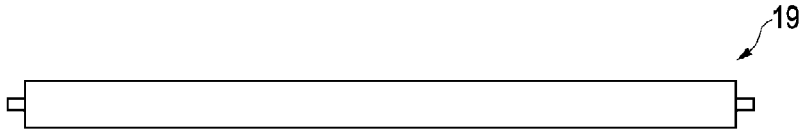
Figure 5:
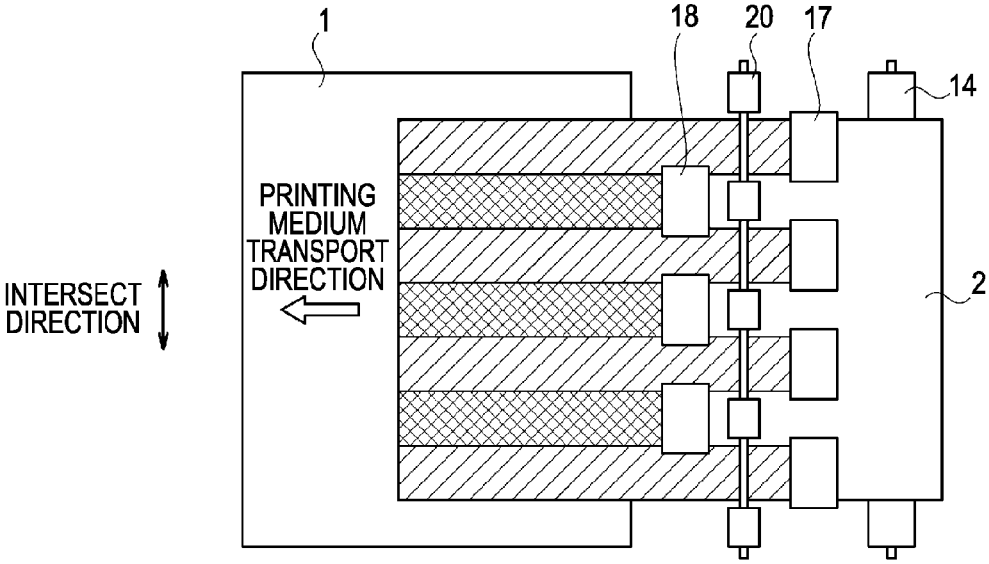
FIG. 5 is a plan view showing a positional relationship between the intermediate pressing roller and head units.

FIGS. 4A to 4C are views showing the intermediate roller 19 and the intermediate pressing roller 20. FIG. 5 is a plan view showing the positional relationship between the intermediate pressing roller 20 and the head units 17 and 18. In addition, in FIG. 5, an area (ink area) on which ink is ejected from the upstream side head unit 17 is indicated by hatching, and an area (ink area) on which ink is ejected from the downstream side head unit 18 is indicated by cross-hatching.

As shown in FIGS. 4A and 5, the intermediate pressing roller 20 has a configuration where a plurality of rollers are disposed along one roller shaft to be separated from each other in the intersect direction. Herein, if the intermediate pressing roller 20 is in contact with the area on which ink droplets are ejected from the upstream side head unit 17, the ink is attached on the intermediate pressing roller 20 or on the following printing medium 2 through the intermediate pressing roller 20, so that the printing medium 2 may be contaminated by the ink. Therefore, as shown in FIG. 5, the intermediate pressing roller 20 abutting the printing surface of the printing medium 2 is disposed so as not to overlap the upstream side head unit 17 in the printing medium transport direction, more strictly, so as not to overlap with the nozzle columns of the upstream side head unit 17 in the printing medium transport direction. In addition, corners (ridges) of the intermediate pressing roller 20 and the intermediate roller 19 may be chamfered so that the occurrence of pressed traces on the printing medium 2 can be suppressed (refer to FIG. 4B). In addition, an intermediate roller 19 that is not in contact with the printing surface, that is, the so-called straight roller may be employed (refer to FIG. 4C).

Returning to FIG. 1, an endless transporting belt (transporting belt 1) as a transporting belt unit that transports the printing medium 2 is disposed at the downstream side of the head unit group 6 and the platen 9. The transporting belt 1 is wound around a driving roller 3 disposed at the downstream side, a driven roller 4 disposed at the upstream side, and a tension roller 5 at the lower side therebetween. The driving roller 3 is driven to be rotated in the arrow direction (counterclockwise) of the figure by a transporting motor (not shown). In addition, the driving roller 3 transports the printing medium 2 passing the printing area in the direction from the driven roller 4 toward the driving roller 3, that is, in the printing medium transport direction.

A charging roller 7 is designed to abut on the transporting belt 1 so as to face the driven roller 4 just before the position to which the printing medium 2 is transmitted. The charging roller 7 is connected to an AC power supply 8 with a frequency of 10 Hz to 50 Hz. The charging roller 7 is pressed on the transporting belt 1 by a spring (not shown). The transporting belt 1 is constructed with a member that is made of a resistant material having intermediate or high resistance. The charging roller 7 together with the grounded driven roller 4 interposes the transporting belt 1, so that a surface of the transporting belt 1 is charged with electric charges. Due to the electric charges, dielectric polarization occurs in the printing medium 2, so that the printing medium 2 is adsorbed on a surface of the transporting belt 1 by the electrostatic force between the electric charges of the printing medium 2 caused by the dielectric polarization and the electric charges on the surface of the transporting belt 1. Therefore, the transporting belt 1 transports the printing medium 2 in a state where the printing medium 2 is electrostatically adsorbed. The tension roller 5 is biased downwards by a tension exerting mechanism (not shown), so that tension is exerted to the transporting belt 1.

In addition, in the specification, a surface on which the printing medium 2 is mounted at the time when the printing medium 2 is transported in the printing medium transport direction is referred to as a "transport surface". Therefore, in the embodiment, a nip portion of the transfer roller 14, the upper surface of the platen 9, a nip portion of the intermediate roller 19, and the surface of the transporting belt 1 ranging from driven roller 4 to the driving roller 3 become the transporting surface, and the printing medium 2 is transported along the transporting surface.

Figure 6:
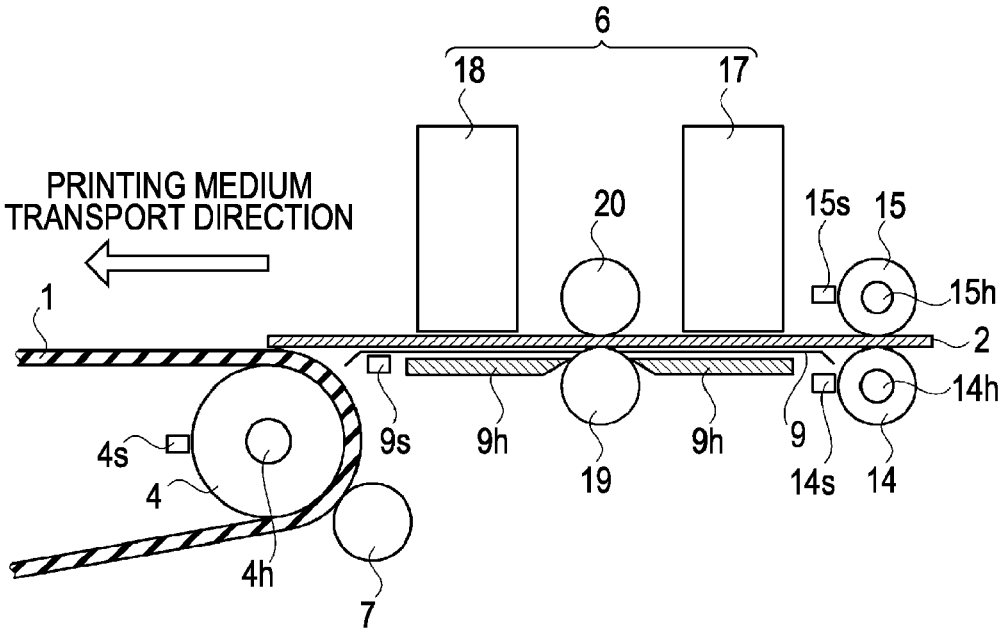
FIG. 6 is a view showing details of a vicinity of the head unit group according to the first embodiment.

FIG. 6 is a view showing details of a vicinity of the head unit group 6. In the figure, shown is the printing medium 2 on which printing is performed by the head unit group 6 and, after that, which is transported in the printing medium transport direction. As shown in the figure, the transfer roller 14 and the pressing roller 15 at the upstream side of the head unit group 6 are embedded with a heater 14*h* and a heater 15*h* as heating units, respectively. As a heating source for the heaters 14*h* and 15*h*, for example, a halogen lamp can be used. In addition, the transfer roller 14 and the pressing roller 15 are provided with a temperature sensor 14*s* and a temperature sensor 15*s*, each of which detects the surface temperature of each roller. When the printing medium 2 is transported in the interposed state by the transfer roller 14 and the pressing roller 15, the heaters 14*h* and 15*h* are designed to heat both of the printing surface and the opposite surface (that is, the rear surface) of the printing medium 2. The temperature sensors 14*s* and 15*s* output temperature detection results (detection signals) to a controller (not shown). The controller controls the heat amounts of the heaters 14*h* and 15*h* based on the detection results output from the temperature sensors 14*s* and 15*s*, so that the surface temperatures of the transfer roller 14 and the pressing roller 15 can be maintained at a constant temperature T1. Herein, the controller is constructed with a CPU (central processing unit), a storage unit, and the like to control the operations of the ink jet printer 100 by the operation of the CPU according to a control program stored in the storage unit.

In addition, herein, the transfer roller 14 and the pressing roller 15 are embedded with the heater 14*h* and the heater 15*h*, respectively. However, the invention is not limited thereto, but it may be that only one of the transfer roller 14 and the pressing roller 15 is embedded with the heater.

In addition, a heater 9*h* is provided as a heating unit to a lower portion of the platen 9 which is disposed to face the head unit group 6. In addition, the platen 9 is provided with a temperature sensor 9*s* which detects the temperature of the platen 9. When the printing medium 2 is transported on the upper surface of the platen 9, the heater 9*h* heats the rear surface of the printing medium 2. The temperature sensor 9*s* outputs a temperature detection result (detection signal) to the controller. The controller controls the heat amount of the heater 9*h* based on the detection result output from the temperature sensor 9*s*, so that the temperature of the platen 9 is maintained at a constant temperature T2.

In addition, the driven roller 4 at the downstream side of the head unit group 6 is embedded with a heater 4*h* as a heating unit. As a heating source for the heater 4*h*, for example, a halogen lamp can be used. In addition, the driven roller 4 is provided with a temperature sensor 4*s* which detects the surface temperature of the driven roller 4. When the printing medium 2 is transported on the upper surface of the transporting belt 1, the heater 4*h* heats the rear surface of the printing medium 2 through the transporting belt 1. The temperature sensor 4*s* outputs a temperature detection result (detection signal) to the controller. The controller controls the heat amount of the heater 4*h* based on the detection result output from the temperature sensor 4*s*, so that the surface temperature of the driven roller 4 can be maintained at a constant temperature T3.

Herein, the temperature T1 that is the surface temperatures of the transfer roller 14 and the pressing roller 15, the temperature T2 of the platen 9, and the temperature T3 that is the surface temperature of the driven roller 4 is controlled by the controller so as to satisfy a relationship of T1<T2<T3.

The ink jet printer 100 having the above configuration performs the following operations under the control of the controller. In addition, the ink jet printer 100 is set to be in the printing state.

Firstly, the ink jet printer 100 extracts one sheet of the printing medium 2 from a feed unit 12 by the auxiliary rollers 10*d* and 10*f*. The printing medium 2 is transferred to the feed rollers 13*d* and 13*f*, and the printing medium 2 is transmitted to the nip portion of the transfer roller 14 and the pressing roller 15. At this time, the surface temperatures of the transfer roller 14 and the pressing roller 15 are maintained at a constant temperature T1 by the controller. The printing medium 2 contacts both surfaces of the transfer roller 14 and the pressing roller 15 during the transporting thereof, so that both of the printing surface and the rear surface of the printing medium 2 are heated. Due to the heating, the printing medium 2 stores the preliminary heat before the printing by the head unit group 6.

Next, the front end portion of the printing medium 2 abuts on the nip portions of the transfer roller 14 and the pressing roller 15, and after that, if a predetermined amount of the printing medium 2 is transmitted by the feed rollers 13*d* and 13*f*, bending occurs in the printing medium 2. After the bending occurs, a transporting force (more specifically, an interposing force) of the feed rollers 13*d* and 13*f* with respect to the printing medium 2 is released, the posture of the printing medium 2 is corrected in the state that the front end portion of the printing medium 2 abuts on the nip portions of the transfer roller 14 and the pressing roller 15.

Next, after the posture of the printing medium 2 is corrected, the ink jet printer 100 transports the printing medium 2 on the platen 9 by rotating the transfer roller 14 and the pressing roller 15. When the printing medium 2 reaches the printing area of the upstream side head unit 17, the ink droplet ejecting (printing) of the upstream side head unit 17 starts. Next, the ink jet printer 100 transports the printing medium 2 on which the printing is performed by the upstream side head unit 17 to the downstream side by interposing the printing medium 2 between the intermediate roller 19 and the intermediate pressing roller 20. Next, when the printing medium 2 reaches the printing area of the downstream side head unit 18, the ink droplet ejecting (printing) of the downstream side head unit 18 starts.

At this time, the temperature of the platen 9 is maintained at a constant temperature T2 by the controller. By causing the printing medium 2 to contact the upper surface of the platen 9, the heating starts from the rear surface of the printing medium 2. The heating temperature is higher than the temperature of the printing medium 2 before the transmitting thereof to the platen 9, so that drying of the ink droplets ejected on the printing surface of the printing medium 2 can be facilitated.

Next, the printing medium 2 on which the printing by the upstream side head unit 17 and the downstream side head unit 18 is performed is slid on the upper surface of the platen 9 and transmitted to the transporting belt 1, so that the printing medium 2 is adsorbed on the surface of the transporting belt 1 by an electrostatic force. The ink jet printer 100 drives the driving roller 3 to rotate in the state where the printing medium 2 is adsorbed on the transporting belt 1. Next, the rotation driving force is transmitted through the transporting belt 1 to the driven roller 4, so that the printing medium 2 is transported toward the discharge unit (not shown) in the printing medium transport direction. When the printing medium 2 reaches a vicinity of the discharge unit, the printing medium 2 is detached from the surface of the transporting belt 1, for example, by a detachment unit (not shown) to be discharged to the discharge unit.

At this time, the surface temperature of the driven roller 4 abutting on the transporting belt 1 is maintained to be a constant temperature T3 by the controller. Therefore, the transporting belt 1 is in the heated state, so that the heating starts from the rear surface of the printing medium 2 by causing the printing medium 2 to contact the upper surface of the transporting belt 1. The heating temperature is higher than the temperature of the printing medium 2 before the transmitting thereof to the transporting belt 1, so that the drying of the ink droplets ejected on the printing surface of the printing medium 2 can be further facilitated.

As described above, according to the ink jet printer 100 of the embodiment, the following effects can be obtained.

(1) According to the ink jet printer 100 of the embodiment, the temperature T1 in the transfer roller 14 and the pressing roller 15, the temperature T2 in the platen 9, and the temperature T3 in the driven roller 4 have a relationship of T1<T2<T3, so that the printing medium 2 can be sequentially heated from a low temperature to a high temperature. Therefore, the temperature of the printing medium 2 before the printing thereof can be suppressed to be low, and the printing medium 2 can be sequentially heated from the time of the printing to the time after the printing, so that the drying of the ink droplets ejected on the printing surface of the printing medium 2 can be facilitated.

Due to the low temperature of the printing medium 2 before the printing thereof, even in a case where the printing of the printing medium 2 is continuously performed, the printing medium 2 can be maintained to be equal to or less than predetermined temperature. As a result, nozzle clogging of the head units 17 and 18 caused by an increase in viscosity of ink can be prevented, so that highly reliable printing without a defective image can be performed. In addition, flushing times can also be reduced, so that printing efficiency can be improved.

In addition, due to the low temperature of the printing medium 2 before the printing thereof, deformation (curling, wrinkling, and the like caused by the drying) of the printing medium 2 before the printing thereof can be suppressed. Accordingly, stable flatness can be achieved in the printing medium 2 at the time of the printing thereof, and printing with a high quality and a small paper gap can be performed.

Moreover, due to the low temperature of the printing medium 2 before the printing thereof, a cooling unit, a heat releasing unit, or the like is not needed in the transporting path where the printing is performed by using the preliminary heating. Accordingly, the ink jet printer 100 can be implemented at a small size by simplifying the structure thereof, and power consumption can be suppressed.

(2) According to the ink jet printer 100 of the embodiment, the transfer roller 14 and the pressing roller 15 are embedded with the heaters 14*h* and 15*h*, respectively. Due to the abutment of the printing medium 2 on the surfaces of the transfer roller 14 and the pressing roller 15, the printing medium 2 stores preliminary heat.

Therefore, even in a case where the printing of the printing medium 2 is continuously performed, the surface temperature of the rollers can be maintained at a constant level, so that the temperature of the printing medium 2 can also be maintained at a predetermined temperature. Accordingly, the ink absorption capability of the printing medium 2 can be maintained at a constant level, so that the occurrence of the concentration non-uniformity, color non-uniformity, or the like can be suppressed. Therefore, uniformity of image quality can be secured.

In addition, due to the heating using the rollers, the printing medium 2 can be heated and dried with a high degree of heat efficiency. Accordingly, the ink jet printer 100 can be implemented at a small size, and power consumption can be suppressed.

(3) According to the ink jet printer 100 of the embodiment, the intermediate transporting unit includes the intermediate pressing roller 20. The intermediate pressing roller 20 abuts on an area other than the area on which the ink is ejected from the upstream side head unit 17 with respect to the printing medium 2. Therefore, the intermediate pressing roller 20 does not abut on the printing surface on which the ink ejected from the upstream side head unit 17 is attached. Accordingly, contamination of the printing medium 2 caused by the ink attached to the intermediate pressing roller 20 can be prevented, and the flatness of the printing area can be improved.

(4) According to the ink jet printer 100 of the embodiment, head units 17 and 18 are also divided (separated) in the intersect direction so as to be aligned in a zigzag shape as viewed in plane. In addition, the intermediate pressing roller 20 is disposed between the upstream side head units 17 adjacent to each other in the intersect direction and between the upstream side head unit 17 and the downstream side head unit 18. Accordingly, the intermediate pressing roller 20 does not abut on the ink that is ejected from the upstream side head unit 17. Accordingly, the contamination caused from the attached ink can be prevented. In addition, the flatness of the printing area can be improved.

(5) According to the ink jet printer 100 of the embodiment, the transporting belt 1 transports the printed printing medium 2 in the state where the rear surface thereof is electrostatically adsorbed. Accordingly, no member is attached on the printing surface of the printing medium 2, and contamination of the printing medium 2 caused by the attached ink can be prevented.

Second Embodiment

Next, an ink jet printer 100 according to a second embodiment will be described. Herein, the same elements as those of the first embodiment are denoted by the same reference numerals, and detailed description thereof is omitted.

Figure 7:
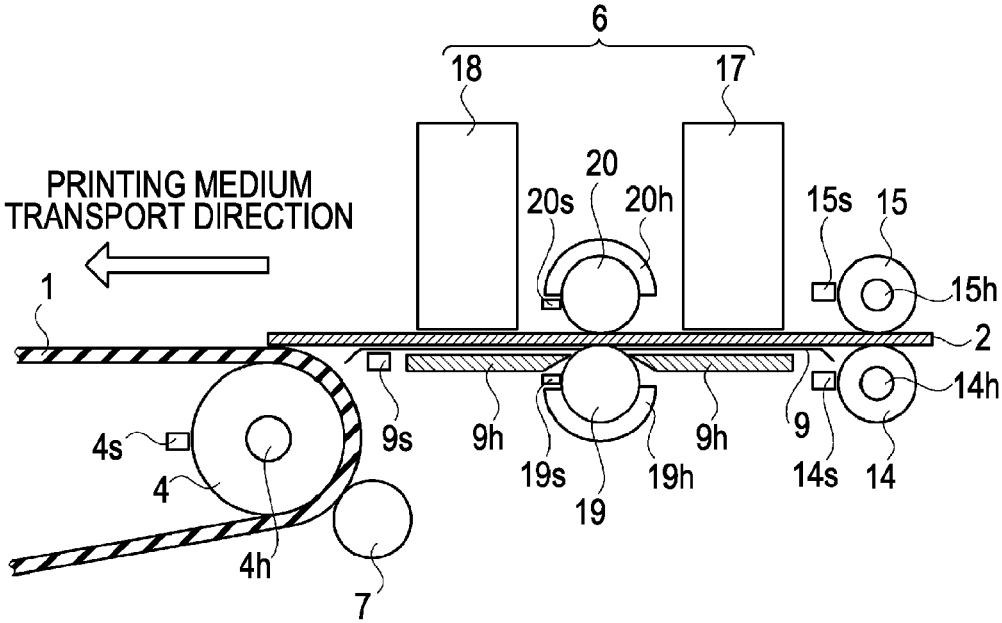
FIG. 7 is a view showing details of a vicinity of a head unit group according to a second embodiment.

FIG. 7 is a view showing details of a vicinity of a head unit group 6 according to the second embodiment. As shown in the figure, in the ink jet printer 100 according to the embodiment, a lower portion of the intermediate roller 19 is covered with an arch-shaped heater 19*h* as a heating unit along the outer circumference of the intermediate roller 19. In addition, an upper portion of the intermediate pressing roller 20 is covered with an arch-shaped heater 20*h* as a heating unit along the outer circumference of the intermediate pressing roller 20. As a heating source for the heaters 19*h* and 20*h*, for example, a halogen lamp can be used. The heaters 19*h* and 20*h* are fixed irrespective of the rotations of the intermediate roller 19 and the intermediate pressing roller 20. In addition, the intermediate roller 19 and the intermediate pressing roller 20 are provided with a temperature sensor 19*s* and a temperature sensor 20*s*, each of which detects the surface temperature of each roller. When the printing medium 2 is transported in the interposed state by the intermediate roller 19 and the intermediate pressing roller 20, the heaters 19*h* and 20*h* are designed to heat both the printing surface and the rear surface of the printing medium 2. The temperature sensors 19*s* and 20*s* output temperature detection results (detection signals) to the controller. The controller controls the heat amounts of the heaters 19*h* and 20*h* based on the detection results output from the temperature sensors 19*s* and 20*s*, so that the surface temperatures of the intermediate roller 19 and the intermediate pressing roller 20 can be maintained at a constant temperature T2.

In the ink jet printer 100 according to the embodiment, the printing medium 2 that is transmitted to the platen 9 is heated by the platen 9, and when the printing medium 2 is transported by the intermediate roller 19 and the intermediate pressing roller 20, both the printing surface and the rear surface thereof are heated. At this time, the temperature of the platen 9 and the surface temperatures of the intermediate roller 19 and the intermediate pressing roller 20 are maintained at a constant temperature T2 by the controller.

According to the ink jet printer 100 of the embodiment, the following effects, in addition to the effects of the first embodiment, can be obtained.

According to the ink jet printer 100 of the embodiment, the intermediate roller 19 and the intermediate pressing roller 20 are covered with the heaters 19*h* and 20*h*, respectively. In addition, at the time of the printing, due to the contact between the printing medium 2 and the platen 9 and the abutment of the printing medium 2 on the surfaces of the intermediate roller 19 and the intermediate pressing roller 20, the temperature of the printing medium 2 can be maintained at a constant level. Therefore, even in a case where the printing of the printing medium 2 is continuously performed, the surface temperature of the rollers can be maintained at a constant level, so that the temperature control in the platen 9 and the rollers can be easily and accurately performed. As a result, the temperature of the printing medium 2 can also be accurately maintained at a constant temperature. Accordingly, the ink absorption capability of the printing medium 2 can be maintained at a constant level with high accuracy every printing, so that the occurrence of concentration non-uniformity, color non-uniformity, or the like can be suppressed. Therefore, the uniformity of image quality can be secured.

Modified Example

In addition, the embodiment can be modified as follows.

In the embodiment, as a transporting unit that transports the printing medium 2, a transporting roller unit (the transfer roller 14 and the pressing roller 15) is disposed at the upstream side of the head unit group 6, and a transporting belt unit (transporting belt 1) is disposed at the downstream side of the head unit group 6. However, the configuration of the transporting unit is not limited thereto, but other configurations can be used.

In the embodiment, the intermediate roller 19 and the intermediate pressing roller 20 are used as the intermediate transporting unit. However, the configuration of the intermediate transporting unit is not limited thereto. For example, instead of the intermediate roller 19, a transporting belt can be used, and instead of the intermediate pressing roller 20, a spur can be used. In addition, the intermediate transporting unit may be removed.

In the embodiment, the transporting belt 1 transports the printing medium 2 in the state that the printing medium 2 is electrostatically adsorbed. However, the transporting belt 1 may have a configuration where the printing medium 2 is adsorbed by using a negative air pressure. For example, the transporting belt 1 is provided with a plurality of small holes, and air may be suctioned from the surface opposite to the transporting surface by a suction fan.

In the second embodiment, the intermediate roller 19 and the intermediate pressing roller 20 are covered by the heaters 19*h* and 20*h*, respectively. However, the invention is not limited thereto, but the intermediate roller 19 and the intermediate pressing roller 20 may be embedded with heaters, respectively. In addition, only one of the intermediate roller 19 and the intermediate pressing roller 20 may be provided with a heater.

In addition, in the second embodiment, the heater 9*h* is provided to the platen 9 so as to heat the printing medium 2. However, the invention is not limited thereto, but the heater 9*h* for the platen 9 may be removed so that the printing medium 2 is heated only by the heaters 19*h* and 20*h* of the intermediate roller 19 and the intermediate pressing roller 20.

What is claimed is:

1. A printing apparatus comprising:

a head unit that ejects liquid on a printing medium that is transported in a printing medium transport direction;

a first transporting roller unit that is disposed at a printing medium transport direction upstream side of the head unit;

a second transporting roller unit that is downstream of the first transporting roller unit;

a transporting belt unit that is disposed at a printing medium transport direction downstream side of the head unit;

an intermediate supporting unit that is disposed at a side facing the head unit; and a heating unit that is disposed to at least one of the first transporting roller unit, the transporting belt unit and the intermediate supporting unit to heat the printing medium, wherein the heating unit heats the printing medium so that a temperature T1 of the first transporting roller unit, a temperature T2 of the intermediate supporting unit, and a temperature T3 of the transporting belt unit satisfy a relationship of T1<T2<T3, wherein the head unit is divided into a plurality of head units having a first group of head units located upstream from the second transporting roller unit and a second group of head units located downstream from the second transporting roller unit, the first and second groups being configured in an alternating formation, wherein the second transporting roller unit includes a plurality of rollers attached to a single shaft, the single shaft including sections that do not include a roller, the sections of the single shaft that do not include a roller being located between each of the plurality of rollers and an adjacent roller, the plurality of rollers being configured such that the sections of the shaft that do not include a roller are aligned with and downstream from the first group of head units and at least some of the plurality of rollers are aligned with and upstream from the second group of head units.

2. The printing apparatus according to claim 1, wherein the transporting roller unit is constructed with a pair of upper and lower rollers, and wherein the heating unit is disposed to at least one of the pair of upper and lower rollers.

3. The printing apparatus according to claim 1, wherein the intermediate supporting unit is a platen that supports the printing medium, and wherein the heating unit is disposed to the platen.

4. The printing apparatus according to claim 1, wherein the transporting belt unit includes a transporting belt, and wherein the heating unit is disposed to a roller that abuts on the transporting belt.

5. The printing apparatus according to claim 1, wherein the second transporting roller unit is constructed with a pair of upper and lower rollers that are disposed between the first group of head units disposed at the printing medium transport direction upstream side and the second group of head units disposed at the printing medium transport direction downstream side.

6. The printing apparatus according to claim 5, wherein the heating unit is disposed to at least one of the pair of upper and lower rollers in the second transporting roller unit.

7. The printing apparatus according to claim 5, wherein one of the pair of upper and lower rollers in the second transporting roller unit is an intermediate pressing roller, and the intermediate pressing roller abuts on a portion other than the area of the printing medium on which the liquid is ejected from the head unit disposed at the printing medium transport direction upstream side.

8. The printing apparatus according to claim 7, wherein the head units at the printing medium transport direction upstream side and the head units at the printing medium transport direction downstream side are disposed so that the position thereof is shifted in an alternate manner in a direction intersecting the printing medium transport direction as viewed in plane, and wherein the intermediate pressing roller is disposed between the adjacent head units disposed at the printing medium transport direction upstream sides in the direction intersecting the printing medium transport direction.

* * * * *